US006792866B2

(12) United States Patent
Grattan

(10) Patent No.: US 6,792,866 B2
(45) Date of Patent: Sep. 21, 2004

(54) CIRCULAR SHAPED CHARGE

(75) Inventor: Tony F. Grattan, Mansfield, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/156,220

(22) Filed: May 28, 2002

(65) Prior Publication Data

US 2003/0221579 A1 Dec. 4, 2003

(51) Int. Cl.[7] ..... F42B 1/028

(52) U.S. Cl. ..... 102/310; 102/307; 102/306; 175/4.6; 166/55

(58) Field of Search ..... 102/306, 307, 102/309, 310, 476; 166/55; 175/2, 4.6

(56) References Cited

U.S. PATENT DOCUMENTS

| | | | | |
|---|---|---|---|---|
| 3,013,491 A | * | 12/1961 | Palter | 102/310 |
| 3,053,182 A | * | 9/1962 | Christopher | 175/4.6 |
| 3,057,295 A | | 10/1962 | Christopher | |
| 3,233,688 A | | 2/1966 | Bell | |
| 4,290,486 A | | 9/1981 | Regalbuto | 188/297 |
| 4,306,502 A | * | 12/1981 | Romer et al. | 102/307 |
| 4,354,433 A | | 10/1982 | Owen | 102/307 |
| 4,724,105 A | * | 2/1988 | Owen | 102/307 |
| 5,046,563 A | | 9/1991 | Engel et al. | 166/297 |
| 5,129,322 A | | 7/1992 | Christopher et al. | 102/202.3 |
| 5,377,594 A | * | 1/1995 | Alford | 102/308 |
| 5,524,546 A | * | 6/1996 | Rozner et al. | 102/307 |
| 6,298,913 B1 | | 10/2001 | Box | 166/55 |
| 6,505,559 B1 | * | 1/2003 | Joslin et al. | 102/310 |

FOREIGN PATENT DOCUMENTS

CA 2350790 A1 3/2002

OTHER PUBLICATIONS

Owen Oil Tools Brochure, "Casing Cutters—Segment Type, 3–7/16" THRU 12" O.D.," 2000.
European Search Report, EP 032S3278, dated Sep. 24, 2003.

* cited by examiner

*Primary Examiner*—Jack W. Keith
*Assistant Examiner*—James S. Bergin
(74) *Attorney, Agent, or Firm*—Albert C. Metrailer

(57) ABSTRACT

A circular shaped charge and methods of manufacture, shipping and assembly. An circular shaped charge is manufactured as two separate charge halves, upper and lower, and a separate continuous liner or pair of continuous half liners. Preferably, each charge half is formed of a number of segments, each comprising a reduced weight of explosive which can be shipped under preferred regulations. The explosive contains sufficient binder to prevent damage to the charge segments during shipping and assembly at a job site. The separately shipped components are assembled at the job site to form a complete circular shaped charge useful, for example, in a tubing cutter.

28 Claims, 5 Drawing Sheets

CIRCULAR SHAPED CHARGE

BACKGROUND OF THE INVENTION

This invention relates to circular shaped charges and more particularly to a system and method for making, shipping and assembling a circular shaped charge which facilitates the safe shipping of explosive components.

The use of shaped-charges for cutting tubular goods such as production tubing, drill pipe, or casings used to line wells such as oil and natural gas wells and the like, is well-known in the art. For example, U.S. Pat. No. 3,057,295, issued Oct. 9, 1962 to G. B. Christopher discloses a shaped-charge apparatus for cutting oil well tubing and the like.

Generally, shaped-charges utilized as tubing cutters include a circular, also described as annular or ring shaped, explosive element having a concave surface around its outer circumference. The concave surface normally has a V shaped cross section. The concave surface of the explosive is lined with a thin metal liner which, as is well known in the art, is explosively driven to hydrodynamically form a flat disk shaped jet of material with fluid-like properties upon detonation of the explosive. This jet of viscous material exhibits a good penetrating power to cut tubing. The shaped charge is often manufactured in the form of two identical half charges, top and bottom halves, each comprising explosive material pressed onto a half liner. Two such half charges may be assembled to form a complete circular shaped charge.

Generally, explosive materials such as HMX, ROX, PYX, HNS or PETN are coated or blended with binders such as wax or synthetic polymeric reactive binders such as chlorotrifluoroethylene, sold under the registered trademark NEOFLON by Daikin Industries (formerly available from 3M Corporation under the trademark KEL-F) or a fluoroelastomer sold by DuPont Dow Elastomers L.L.C. under the registered trademark VITON. The resultant mixture is cold- or hot-pressed directly into a shaped-charge case or onto a full or half liner. The resulting shaped-charges are initiated by means of a booster or priming charge in the form of a pellet positioned in the center of the circular main charge and located so that a detonating fuse, detonating cord or electrical detonator may be positioned in close proximity to the priming charge.

The shipment of explosives is carefully regulated by various government agencies, primarily for safety purposes. The regulations impose various levels of restrictions depending upon type of explosive, weight of individual explosive components, total weight in an individual package, relative positioning of multiple explosive components in a single package, types of packaging materials and other factors. It is desirable for the explosives used in shaped charges to meet the requirements for the least restrictive shipping rules both because it reduces the expense and time for shipping and means that the risk of accidents has been minimized.

SUMMARY OF THE INVENTION

The present invention provides a structure and methods for making and assembling a circular shaped charge which improves safety in shipping the charge components to a work location. The shaped charge comprises explosive half charges pressed into a desired shape and a separate continuous charge liner or continuous half liners. Each half charge preferably comprises a plurality of segments which may be assembled to form a complete half charge.

In a preferred manufacturing process, explosive segments are individually pressed into final form at the factory. The explosive is preferably mixed with a binder to increase its mechanical strength and ability to be shipped without breakage.

The half charges or segments are preferably separately packaged for shipment. When received at the job site, the individual half charges or segments are assembled with the liner or half liners to form a complete circular shaped charge. The complete circular shaped charge may then be assembled into a tubing cutter tool and used in a well for cutting tubing, drill pipe, etc.

DETAILED DESCRIPTION OF THE INVENTION

Figure 1:
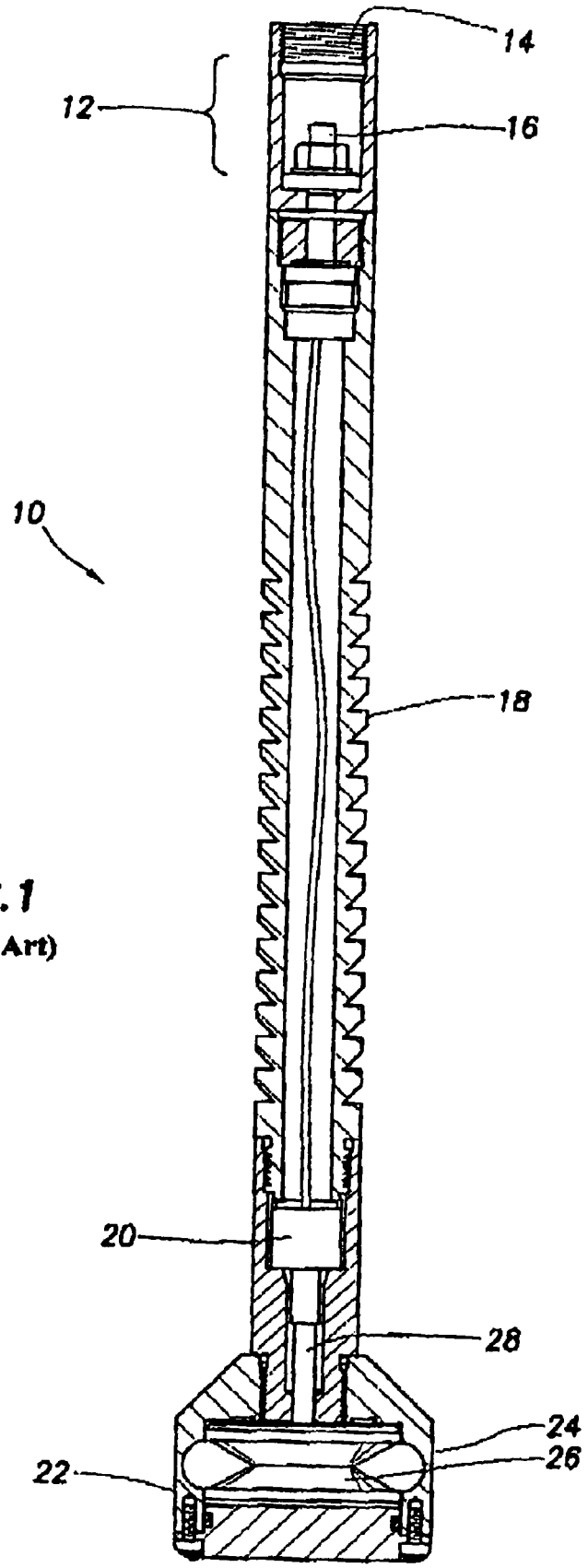
FIG. 1 (Prior Art)
FIG. 1 is a partially cross sectional illustration of a complete tubing cutter tool for use in a wellbore.

With reference now to FIG. 1, a shaped charge tubing cutter 10 in fully assembled form is shown. The structure, as assembled, is similar to prior art devices and is the structure of a fully assembled tubing cutter according to the present invention. At the upper end of the tubing cutter 10 is a connector section 12 including a threaded portion 14 for mechanical connection to a wireline, slickline, coiled tubing, etc. and an electrical connection 16. Below the connector section is an extension mandrel 18 which provides shock protection or isolation for the connector section 12 and supporting wireline, etc. Near the bottom of the extension mandrel 18 is a detonator 20. A cartridge assembly 22 is connected to the lower end of mandrel 18. The cartridge assembly 22 includes a housing 24 containing a circular shaped charge 26. A booster rod 28 extends from the detonator 20 to the shaped charge 26.

Figure 2:
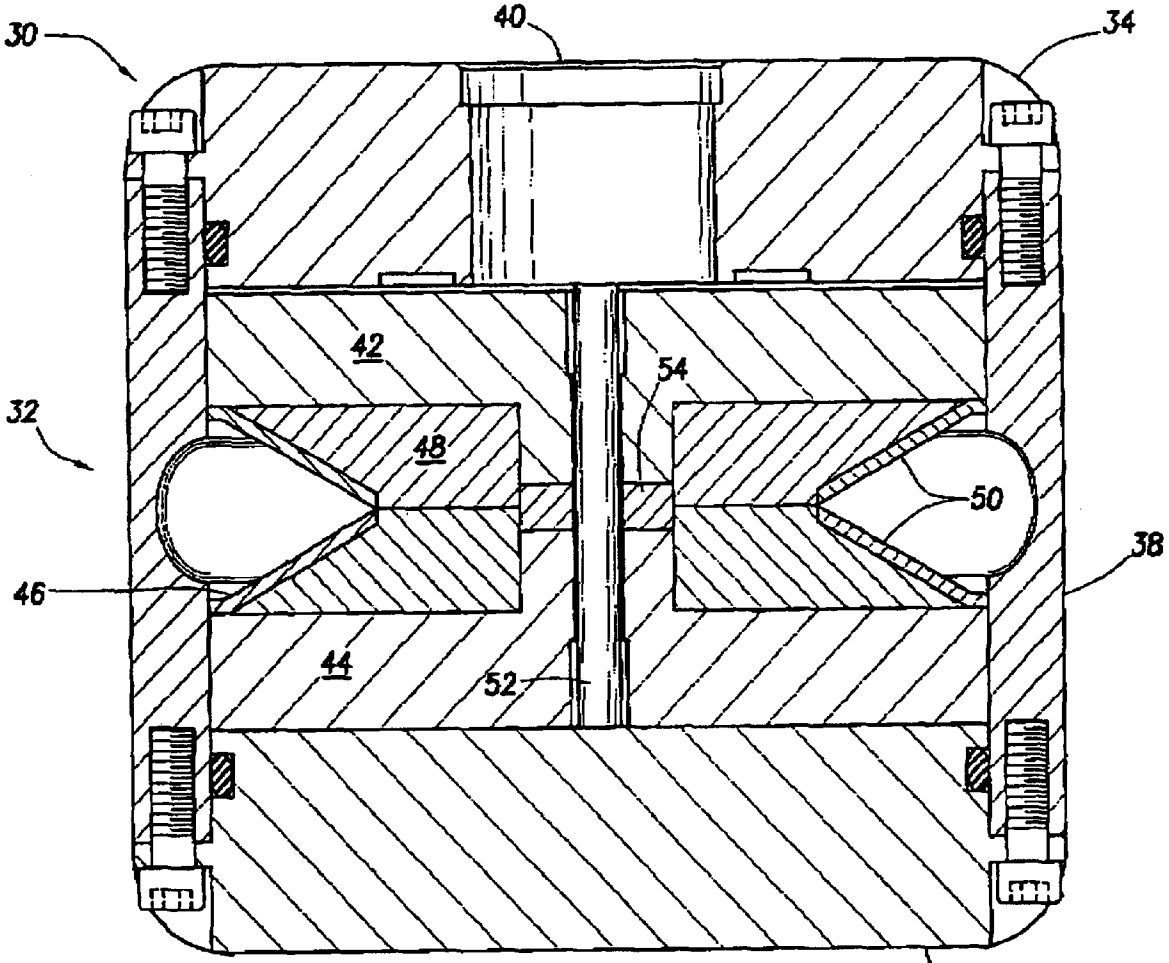
FIG.2 (Prior Art)
FIG. 2 is a cross sectional illustration of an alternative shaped charge cartridge assembly which may be used in the tool of FIG. 1.

FIG. 2 provides a cross sectional view of a slightly modified cartridge assembly 30 showing more details of the structure of a circular shaped charge 32. The cartridge assembly 30 includes a top cap 34 and a bottom cap 36 mechanically coupled together by a cylindrical housing 38. Top cap 34 has a threaded opening 40 for receiving the lower end of an extension mandrel 18. The housing also includes an upper retainer 42 and a lower retainer 44, which may be identical.

The shaped charge 32 may be identical to the shaped charge 26 of FIG. 1. It is positioned between upper retainer 42 and a lower retainer 44. It is of a generally circular or annular shape with a concave outer perimeter 46. A complete shaped charge is made of two parts, an explosive material and a liner. In FIG. 2, the body or bulk portion 48 of the circular shaped charge 32 is formed of explosive material. A metallic liner 50 covers, or lines, the concave outer perimeter 46. The liner 50 is an active part of the shaped charge 32. The concave outer perimeter 46 and liner 50 are illustrated with a V shaped cross section which is generally preferred for tubing cutters because it generates a narrowly focused jet. However, the concave outer perimeter 46 could have other cross-sections if desired, for example circular, parabolic, ellipsoidal, flattened parabolic, hyperbolic, etc.

Also shown in FIG. 2 are a booster rod 52 and an initiation pellet 54. As shown in FIG. 1, the booster rod 52 is made of explosive material and couples the detonator 20 to the shaped charge 32. The initiation pellet 54 is also made of explosive material and surrounds the booster rod 52 to couple the booster rod to the shaped charge 32.

In prior art systems, the shaped charge 32 has been manufactured and assembled in a variety of ways. Generally the explosive material 48 has been pressed into final form in a mold formed in part by a liner. The liner is not only an active part of the shaped charge, but also provides mechanical strength and stability to the shaped charge during shipping and assembly into a tubing cutter cartridge. Alternatively, the charge 32 has been pressed into final form as upper and lower halves and then bonded to half liners, for example with an adhesive.

Figure 3:
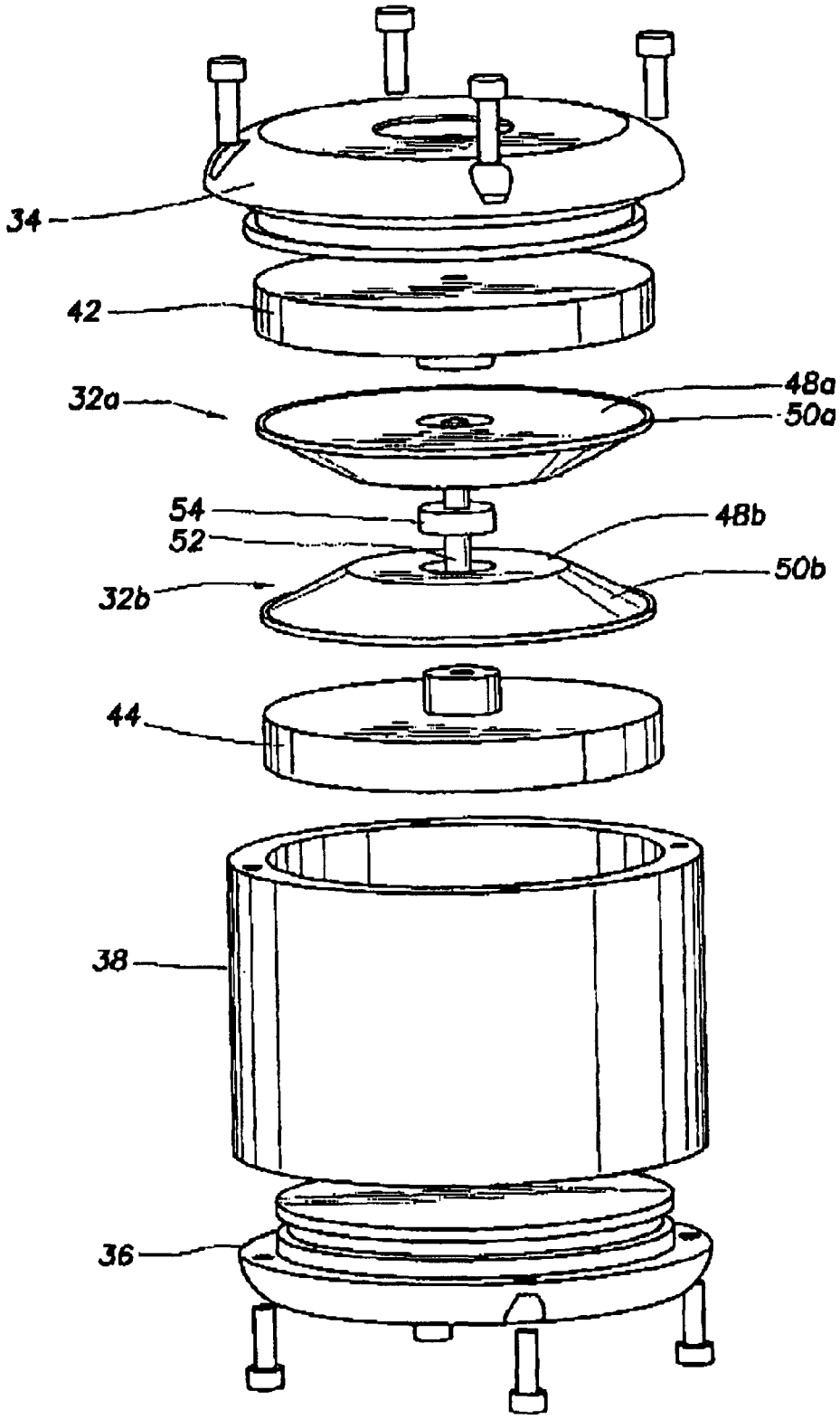
FIG.3 (Prior Art)
FIG. 3 is an exploded view of the FIG. 2 assembly according to the prior art.

FIG. 3 is an exploded view of the FIG. 2 cartridge according to the prior art. The corresponding parts are given the same reference numbers. In FIG. 3, the shaped charge 32 of FIG. 2 is shown as comprising two identical shaped charge halves 32*a* and 32*b*. The shaped charge halves 32*a* and 32*b* are made of half charges 48*a* and 48*b* pressed on to half liners 50*a* and 50*b*. Alternatively, each half charge 48*a* and 48*b* may have been pressed into final form and then bonded to the half liners 50*a* and 50*b* with an adhesive. In either case, each shaped charge half includes an explosive portion and a liner portion when it is packaged at the factory for shipment.

FIG. 3 illustrates that assembly of the shaped charge cartridge 30 is simply a matter of attaching bottom cap 36 to housing 38 and then stacking the lower retainer 44, lower shaped charge half 32*b*, initiation pellet 54, upper shaped charge half 32*a*, and upper retainer 42 into the housing 38. The top cap 34 is then attached to housing 38. The booster rod 52 may then be inserted through top cap 34 and initiation pellet 54.

One advantage of forming the shaped charge 32 as identical top and bottom halves 32*a* and 32*b* is that the total explosive charge is separated into two parts for shipping. This improves safety and may result in a lower shipping classification. However, tubing cutters normally require charges of such size that even half of the charge exceeds the maximum weight for the least restrictive shipping classification. Various efforts have been made to further reduce the weight of explosive components to improve safety in shipping.

In U.S. Pat. No. 4,354,433, issued to Owen on Oct. 19, 1982, a tubing cutter shaped charge is formed as a plurality of shaped charge segments instead of separate top and bottom halves. Each explosive segment is pressed in a liner segment which provides mechanical integrity for the explosive segment during shipping. However, shipping a charge with any form of metallic liner increases the risk of accident and raises the shipping classification. The weight of the liner is included in the charge weight and therefore tends to raise the classification, or requires that segments be made smaller. In addition, the liner increases the damage which would occur in case of accidental detonation. As noted above, the liner is an active part and contributes significantly to the ability of the charge to penetrate and sever a pipe. With the liner segment in place, each charge segment forms a functional shaped charge.

It is believed that a tubing cutter shaped charge assembled from a segmented liner does not function as well as a shaped charge with a continuous liner. It is preferred that the disc shaped jet of metal fired from a shaped charge be circumferentially continuous and uniform. A discontinuous liner may not provide these desirable characteristics as effectively as a continuous liner. The proper functioning of a device assembled with a discontinuous liner is dependent on the skill of the person assembling the device and thus will vary from one assembly to the next.

Another approach to reducing shipping risk is disclosed in U.S. Pat. No. 5,046,563 issued to Engel et al. on Sep. 10, 1991. In this patent, the main explosive is a plasticized explosive know as C4 which may be shipped in a number of small tubes. The complete tubing cutter is assembled on site by manually shaping and pressing the explosive into a cavity formed by a cartridge housing and a liner or pair of half liners. Proper assembly again depends on the skill of the assembler to use the right amount of explosive and to fully fill the cavity which shapes the charge. The C4 explosive is not rated for use at temperatures above 225° Fahrenheit and therefore may not be acceptable for use in high temperature wells.

Figure 4:
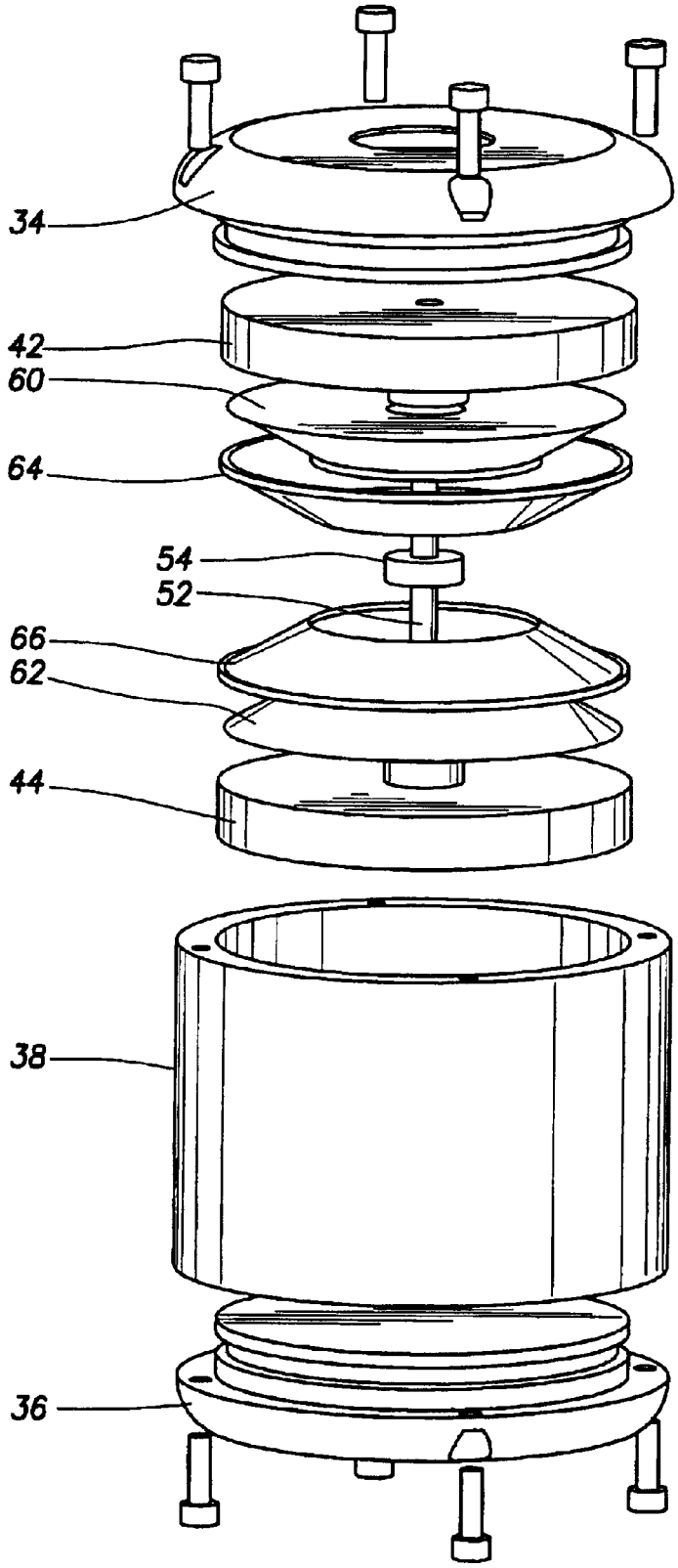
FIG. 4 is an exploded view of the FIG. 2 assembly according to the present invention.

FIG. 4 is an exploded view of a tubing cutter cartridge according to one embodiment of the present invention. Most parts of the assembly may be identical to the assembly of FIG. 3 and are given the same reference numbers. These include: top cap 34, upper retainer 42, initiation pellet 54, booster rod 52, lower retainer 44, housing 38 and lower cap 36. However, in this embodiment a circular shaped charge is assembled from four separate parts: an upper half charge 60, an upper continuous half liner 64, a lower continuous half liner 66 and a lower half charge 62. Half charges 60 and 62 may be and are preferably identical. Likewise, continuous half liners 64 and 66 may be and are preferably identical.

As is apparent from the above discussions, the term "continuous" as used in this disclosure means circumferentially continuous. A continuous liner is formed of a full circle of liner material and is not broken into segments as has been done in some prior art devices. A continuous liner may be formed of two continuous half liners, upper and lower, as shown in the drawings. Each half liner is continuous, because is forms a full circle.

Figure 5:
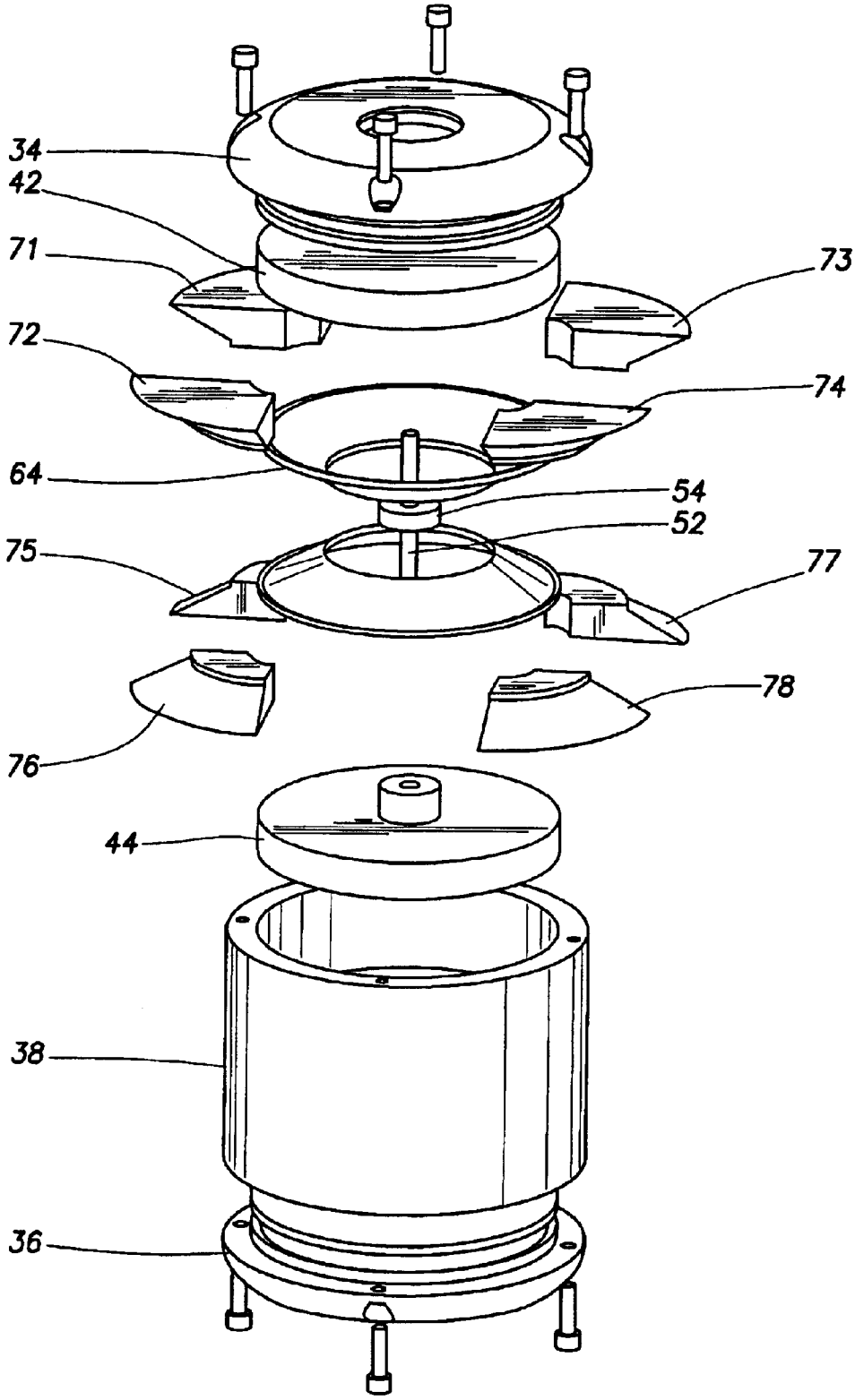
FIG. 5 is an exploded view of the FIG. 2 assembly according to an alternate embodiment of the present invention.

FIG. 5 is an exploded view of a tubing cutter cartridge according to another embodiment of the present invention. Most parts of the assembly may be identical to the assembly of FIG. 4 and are given the same reference numbers. These include: top cap 34, upper retainer 42, upper continuous half liner 64, initiation pellet 54, booster rod 52, lower continuous half liner 66, lower retainer 44, housing 38 and lower cap 36. In this embodiment an upper half charge is formed of four segments 71, 72, 73 and 74. Likewise a lower half charge is formed of four segments 75, 76, 77 and 78. The eight charge segments 71–78 are preferably identical and each forms one fourth or 90 degrees of a full circular or annular half charge, e.g. half charge 60 or 62 of FIG. 4.

The present invention was tested by assembling and firing a device as shown in FIG. 5 with a cartridge diameter of 5.5 inch. Two half charges, like half charges 60 and 62 shown in FIG. 4, were molded of HMX explosive with about 5% VITON fluoroelastomer binder. Each half charge weighed about 116 grams. Each half charge was then manually cut into four segments, like segments 71–78 shown in FIG. 5. Individual charge segments weighed between 27 and 31 grams. The charge segments were then assembled into a complete cartridge as illustrated in FIG. 5. The total weight of explosive, including a booster pellet was about 254 grams. The cartridge was assembled with a mandrel 18 to form a complete tubing cutter device as illustrated in FIG. 1. The device was positioned in the center of a length of 7 inch, 32 pound per foot pipe, which was positioned within a section of 9⅝ inch witness casing. The entire test assembly was placed in a water filled container. Upon firing the tubing cutter, the 7-inch pipe was cleanly cut into two pieces and the witness casing was slightly bulged, but not perforated. The device performed as intended.

While HMX explosive was used in the test device, other explosives such as RDX, PYX, HNS or PETN known to be useful in tubing cutter applications may be used. While the test device used a fluoroelastomer binder sold by DuPont Dow Elastomers L.L.C. under the registered trademark VITON, other synthetic polymeric reactive binders such as chlorotrifluoroethylene; sold under the registered trademark NEOFLON by Daikin Industries (formerly available from 3M Corporation under the trademark KEL-F) may also be used. Polymeric reactive binders are preferred for use in the present invention. However, other types of binders such as wax may be used if desired. The particular choices of explosive type and binder type are affected by the downhole temperature of the well in which tubing is to be cut as is known in the art.

The test explosive included about 5% by weight of a binder. To be effective, the binder should be in the range of from about 0.5% to about 10% by weight, preferably from about 1% to about 7% by weight and more preferably in the range of 3% to 5% by weight. Effectiveness of the binder is determined by two main factors. A minimum amount of binder is preferred to give the compressed half charge or segment sufficient strength to retain its molded shape and reduce or eliminate cracking, breaking or flaking off during handling, shipping and field assembly. However the maximum amount of binder is preferably limited because the binder replaces part of the explosive material, reducing its energy density and effectiveness as an explosive.

In FIG. 5 and in the test device, each half charge was cut into four segments. In the test device, this resulted in individual segment weights of about 30 grams. The number of segments can be increased as needed to reduce the individual segment weight below any shipping weight limit. For example, the same original half charge weighing about 120 grams could be cut into six segments each weighing about 20 grams. Thus the present invention makes it quite easy to meet any package weight limit as set by current or future regulations. For small diameter tubing cutters, it may not be necessary to separate the upper and lower charge halves into segments. That is, each half may contain a only a small amount of explosive and meet preferred classifications without subdividing into segments.

In the test device, the half charge segments were formed by manually cutting full half charges. It is preferred to provide dies or molds and to press the segments separately. Pressing a smaller amount of explosive inherently presents less risk than pressing a full half charge. In addition, the segments can be more uniformly shaped by individual pressing. In the test device, the manual cutting process caused some deformation of the charge segments. As a result there were some slight misalignments or gaps at the points where adjacent charge segments met when the complete half charges were assembled. While these did not cause any noticeable problem in the test device, it is preferred that the segments form a complete annular shape with essentially no gaps to insure uniformity of the shaped charge function. By pressing the individual segments in precise molds, the segments can be mated with essentially no gaps.

In the test device, the half liners, illustrated as elements 64 and 66 in FIGS. 4 and 5, were made of soft copper. The liner can also be made of other materials such as, copper alloy, aluminum, aluminum alloy, tin, tin alloy, lead, lead alloy, powdered metal, powdered metal within a polymeric base, and sintered metal. Use of half liners has a number of advantage in manufacture and shipping. However, if desired, the complete liner can be manufactured, or two half liners can be joined at the factory to form a full liner. Either half or full liners can be assembled to form the same complete device. In either case, the liner is circumferentially continuous.

The test device was assembled without any extra adhesives or binders to hold the various parts together. The conical shape of continuous liners naturally holds charge segments together when the complete cartridge is assembled. If desired, a spring or other compressible element, e.g. a disk of foam rubber, can be added to the stack of parts illustrated in FIGS. 4 and 5, preferably between lower retainer 44 and bottom cap 36. If desired, a suitable adhesive may be applied to the surfaces of segments 71–78 and the half liners 64 and 66. Such adhesive may avoid any movement of parts during handling of a completed cartridge and may be used to exclude any possible air gap between liners and explosives. However, the test device performed properly without any adhesives. In some cases it may be desirable to disassemble and reship a device which has been prepared for use at a well site. Use of adhesives may prevent disassembly and shipment of the assembled device may not be allowed, even if a shipping container is available.

It may be desirable to eliminate essentially all air from gaps which may exist between charge segments, between half charges and between charges and liners. This may reduce any attenuation of shock waves which may otherwise occur. The adhesives mentioned above would provide this air displacement function. However materials other than adhesives may be used for this purpose. The charge segments may be coated with various gels or viscous fluids prior to assembly, e.g. mineral oil, grease, a liquid explosive, etc. Only small amounts would be required since the parts may be molded to close tolerances and will fit with only small air gaps. With the small gaps, capillary forces should retain fluids in the gaps.

The methods of manufacturing, shipping and assembly will now be described. For any given diameter and weight of tubing to be cut, a known quantity of explosive is required. For example, the test device used 254 grams to cut 7 inch, 32 pound per foot pipe. From this known amount, the weight of each half charge can be determined. Published shipping regulations can be consulted to determine the maximum weight of explosive which can be shipped under a given classification. From these values, the number of segments required to form a given shaped charge can be calculated. An appropriately shaped and sized die or mold is then machined and used to press the required number of half charge segments from a selected explosive and binder mix.

The individual half charge segments and other explosive elements, i.e. the booster rod, ignition pellet and detonator are then separately packaged and shipped according to regulations. Separate packaging can take several forms. Each explosive component may be packaged in a physically separate container for shipment. Since there may be a large number of individual explosive components which are relatively small, this may result in a large number of small packages. It may be more practical to place a number of explosive components in a package which is internally divided into multiple compartments which keep the components separated and positioned in a predetermined relationship. Each compartment may desirably contain cushioning material to protect the component within each compartment. Each compartment may be in the form of a separate small package or in the form of a molded insert, e.g. something like egg crate packaging. A molded insert may provide both separate compartments and desirable cushioning properties, e.g. a molded foam rubber insert. Such compartmentalized packaging can be approved for preferred shipping classifications.

The inert elements, including charge liners are also separately packaged for shipment. As with the explosive components, the inert components may be in physically separate packages or in compartments in a larger package.

When the package or packages are received at a field office or well site, the various explosive and inert components may be removed from their packages or compartments. It is preferred to retain the packaging until after the device has been used. If for any reason the device must be returned to the factory, the explosive components should be returned to their separate shipping containers or compartments to meet the shipping regulations.

The individual components are assembled as described above with reference to FIGS. 4 and 5. The completed tubing cutter is then attached to any of the known means for conveying tools down a well, for example a wireline, slickline, coiled tubing, etc. For conveyance means which include electrical conductors, e.g. a wireline, the tubing cutter may be connected through such conductors to fire control equipment at the surface. For conveyance means which may not include electrical conductors, e.g. a slickline, a telemetry device may be coupled to the tubing cutter and sent downhole with the tubing cutter. The fire control signal may then be telemetered downhole, e.g. by acoustic, electromagnetic, etc. signals. It is preferred to attach a centralizer to the tubing cutter so that it will be centrally positioned in the tubing when detonated. The device is lowered to the location where a tubing, drill string, etc. is to be cut. The device is then fired to sever the tubing. The conveyance means is then removed from the well. Then the tubing, drill string, etc. may be withdrawn from the borehole to complete a pipe recovery operation.

From the above descriptions of the structure of circular shaped charges according to the present invention and the methods of making, shipping and using such shaped charges it can be seen that a number of advantages may be achieved. The completed devices use explosives preferred because they can be formed into essentially solid exact shapes needed for good shaped charge performance and because of their energy density and temperature characteristics. In addition, the devices use continuous charge liners which are believed to provide more consistent circumferentially uniform cutting patterns. By using binders, the explosive elements are manufactured in physically rugged segments which each may have a reduced total charge weight which can be shipped under preferred shipping regulations. The charges as shipped do not have an attached liner or liner segment, which would increase shipping risks and subject the shipment to more difficult shipping regulations.

While the preferred embodiment circular shaped charge is employed as a tubing cutter, those of skill in the art will recognize that such circular shaped charges may be used for other uses as well. Many of the potential advantages addressed in this disclosure would equally apply to circular shaped charges used to accomplish other or more complex functions.

It is apparent that various changes can be made in the apparatus and methods disclosed herein, without departing from the scope of the invention as defined by the appended claims.

What is claimed is:

1. A circular shaped charge comprising:

a pair of circular half charges, each half charge comprising a plurality of segments of a substantially solid mixture of an explosive material and a binder formed into a predetermined shape, said shape selected to form a concave outer edge when said segments are assembled into a pair of circular half charges and said pair of circular half charges are placed together, and a continuous liner shaped to mate with said concave outer edge.

2. A circular shaped charge according to claim 1 wherein each half charge comprises four segments, each forming about one fourth of a circular half charge.

3. A circular shaped charge according to claim 1 wherein each of said segments is substantially identical.

4. A circular shaped charge according to claim 1, wherein said explosive material is selected from one of HMX, RDX, PYX, HNS and PETN.

5. A circular shaped charge according to claim 1, wherein said binder comprising from about 0.5 percent to about ten percent by weight of the combined explosive and binder.

6. A circular shaped charge according to claim 1, wherein said binder comprising from about one percent to about seven percent by weight of the combined explosive and binder.

7. A circular shaped charge according to claim 1, wherein said binder comprising from about three percent to about five percent by weight of the combined explosive and binder.

8. A circular shaped charge according to claim 1, wherein said liner is formed of two half liners.

9. A circular shaped charge according to claim 1, wherein said liner comprises a material selected from the group copper, copper alloy, aluminum, aluminum alloy, tin, tin alloy, lead, lead alloy, powdered metal, powdered metal within a polymeric base, and sintered metal.

10. A circular shaped charge according to claim 1, further comprising an essentially non-compressible material filling spaces between adjacent segments.

11. A circular shaped charge according to claim 10, wherein said non-compressible material is an adhesive material.

12. A circular shaped charge according to claim 1, further comprising an essentially non-compressible material filling spaces between said pair of half charges.

13. A circular shaped charge according to claim 12, wherein said non-compressible material is an adhesive material.

14. A circular shaped charge according to claim 1, further comprising an essentially non-compressible material filling spaces between said half charges and said liner.

15. A circular shaped charge according to claim 14, wherein said non-compressible material is an adhesive material.

16. A method for making a circular shaped charge comprising:

forming a plurality of shaped half charge segments of a substantially solid mixture of an explosive material and a binder formed into a predetermined shape, said shape selected to form a concave outer edge when said segments are assembled into a pair of circular half charges and said pair of circular half charges are placed together, and forming a continuous liner shaped to mate with said concave outer edge.

17. A method according to claim 16, further comprising:

separately packaging each shaped charge segment, and separately packaging said continuous liner.

18. A method according to claim 16, further comprising shipping said shaped charge segments and said continuous liner to a work site.

19. A method according ta claim 18, further comprising:

assembling said segments into two circular half charges, and assembling said two circular half charges and said liner to form a circular shaped charge.

20. A method according to claim 19, further comprising filling spaces between adjacent pairs of segments with an essentially incompressible material.

21. A method according to claim 20, wherein said essentially incompressible material is an adhesive.

22. A method according to claim 19, further comprising filling spaces between said pair of half charges with an essentially incompressible material.

23. A method according to claim 22, wherein said essentially incompressible material is an adhesive.

24. A method according to claim 19, further comprising filling spaces between said pair of half charges and said liner with an essentially incompressible material.

25. A method according to claim 24, wherein said essentially incompressible material is an adhesive.

26. A method according to claim 16, wherein said step of forming comprises pressing a mixture of explosive and binder into a mold having said predetermined shape.

27. A method according to claim 16, further comprising:

determining a maximum charge weight which may be shipped in a selected shipping classification, and selecting a number of shaped half charge segments so that each segment weighs no more than said maximum charge weight.

28. A kit for making a circular shaped charge comprising:

a pair of circular half charges, each half charge comprising a plurality of segments of a substantially solid mixture of an explosive material and a binder formed into a predetermined shape, said shape selected to form a concave outer edge when said segments are assembled into a pair of circular half charges and said pair of circular half charges are placed together, and a continuous liner shaped to mete with said concave outer edge, whereby the kit elements may be separately packaged and shipped to a worksite.

* * * * *

UNITED STATES PATENT AND TRADEMARK OFFICE

CERTIFICATE OF CORRECTION

PATENT NO. : 6,792,866 B2
DATED : September 21, 2004
INVENTOR(S) : Grattan

It is certified that error appears in the above-identified patent and that said Letters Patent is hereby corrected as shown below:

Column 10,
Line 20, replace “mete” with -- mate --.

Signed and Sealed this

Twenty-ninth Day of March, 2005

JON W. DUDAS
*Director of the United States Patent and Trademark Office*